US006040516A

United States Patent [19]

Masuda

[11] Patent Number: 6,040,516

[45] Date of Patent: Mar. 21, 2000

[54] TONE GENERATION SYSTEM USING COMPUTER SOFTWARE AND STORAGE MEDIUM STORING THE COMPUTER SOFTWARE

[75] Inventor: Hideyuki Masuda, Hamamatsu, Japan

[73] Assignee: Yamaha Corporation, Hamamatsu, Japan

[21] Appl. No.: 09/281,167

[22] Filed: Mar. 30, 1999

[30] Foreign Application Priority Data

Mar. 31, 1998 [JP] Japan ..... 10-103946

[51] Int. Cl.[7] ..... G10H 1/08

[52] U.S. Cl. ..... 84/622; 84/661; 84/DIG. 9; 84/DIG. 10

[58] Field of Search ..... 84/622–625, 659–661, 84/DIG. 9, DIG. 10

[56] References Cited

U.S. PATENT DOCUMENTS 5,117,729 6/1992 Kunimoto .

FOREIGN PATENT DOCUMENTS 10-74088 3/1998 Japan .

*Primary Examiner*—Stanley J. Witkowski
*Attorney, Agent, or Firm*—Graham & James LLP

[57] ABSTRACT

There are provided a tone generator system using computer software and a storage medium storing the computer software. A musical tone synthesis module generates a musical tone signal by generating an excitation signal in response to an request for generating the excitation signal and at least delaying and looping the generated excitation signal. A first monitoring module monitors whether or not the request for generating the excitation signal is issued. A second monitoring module monitors whether or not the musical tone signal is generated by the musical tone synthesis module. An interruption module interrupts execution of the musical tone synthesis module when the first monitoring module detects that the request for generating the excitation signal is not issued, and at the same time the second monitoring module detects that the musical tone signal is not generated.

10 Claims, 9 Drawing Sheets

TONE GENERATION SYSTEM USING COMPUTER SOFTWARE AND STORAGE MEDIUM STORING THE COMPUTER SOFTWARE

BACKGROUND OF THE INVENTION

1. Field of the Invention

This invention relates to a tone generator system for synthesizing musical tones by using computer software, and a storage medium storing the computer software.

2. Prior Art

Conventionally, a tone generator system for synthesizing musical tones by using computer software has been proposed e.g. by U.S. Pat. No. 5,117,729, in which the sounding mechanism (physical phenomena) of a natural musical instrument is simulated for synthesis of musical tones having a tone color of the natural instrument. This type of tone generator system is called "physical model tone generator".

The physical model tone generator simulates the sounding mechanism of a natural musical instrument in the following manner:

If a natural musical instrument to be simulated is a wind instrument, a signal (excitation signal) representative of breath pressure of a player is generated, and a physical phenomenon occurring after the generation of the breath pressure and until the breath pressure passes through the instrument tube and turns into a musical tone signal is simulated at least by delaying and looping the excitation signal.

On the other hand, if the natural musical instrument to be simulated is a string instrument, a signal (excitation signal) is generated which is representative of an initial vibration of a string determined by the speed and pressure of bowing by the player, and a physical phenomenon occurring after the generation of the initial vibration and until the initial vibration causes vibration of the string and the vibration turns into a musical tone signal is simulated at least by delaying and looping the excitation signal.

The physical model tone generator that simulates the sounding mechanism of a natural musical instrument at least by delaying and looping an excitation signal as described above can be easily implemented by computer software. Actually, computer software programs implementing the physical model tone generator are commercially available.

However, in the conventional physical model tone generator, i.e. the physical model tone generator implemented by computer software, musical tones are generated almost only by computation. This requires the computer to execute a large amount of operation. Further, the amount of operation required increases with an increase in the number of musical tones generated simultaneously, imposing a heavy burden on a CPU of the computer even if the CPU has current improved performance. The amount of operation required is almost the same even when the physical model tone generator does not output any musical tone, i.e. when no tone is being generated. In other words, the CPU is under at least a certain level of computational load all the time during operation. As a result, when the physical model tone generator is started and when its processing is being executed, it can sometimes happen that other application programs cannot be started or executed even though no tone is being generated.

The above described problem of the computational load on the CPU also applies to software tone generators (i.e. tone generators for synthesizing musical tones by using computer software) other than the physical model tone generator, which also suffer from the above problem to a greater or lesser degree. To solve this problem, the present assignee has proposed a technique of reducing the computational load on a CPU employing a software tone generator of FM method type by Japanese Laid-Open Patent Publication (Kokai) No. 10-74088. According to this technique, an output waveform of a musical tone signal is signal monitored, and when its amplitude becomes smaller than a predetermined reference value, computation by a predetermined waveform generating block (block described by software) is stopped for reduction of the computational load on the CPU.

To reduce the computational load on the CPU when the physical model tone generator is employed as a software tone generator, one may consider simply applying the above technique for the software tone generator of FM method type to the physical model tone generator such that musical tone outputs are monitored and processing by the physical model tone generator is stopped when a no tone-generating condition is detected.

In the physical model tone generator, however, since a musical tone is generated at least by delaying and looping an excitation signal, as described above, there is a delay between a time point a command for sounding is issued and a time point a musical tone signal is output. Therefore, there can be a case in which a command for sounding is issued even when no tone is generated. In such a case, if the physical model tone generation processing is stopped based solely upon results of monitoring the output waveform of the musical tone signal, it would cause interruption of computation for tone-signal synthesis, resulting in that a musical tone intended by the player is not generated.

SUMMARY OF THE INVENTION

It is an object of the invention to provide a tone generator system using computer software which is capable of reducing a computational load on a CPU of the system by detecting a genuine no-tone generating condition and interrupting physical model tone generation processing upon detection of the genuine no tone-generating condition, even when a physical model tone generator is employed as a software tone generator, and a storage medium storing the computer software.

To attain the above object, according to a first aspect of the invention, there is provided a tone generator system using computer software, the computer software comprising a musical tone synthesis module for generating a musical tone signal by generating an excitation signal in response to an request for generating the excitation signal and at least delaying and looping the generated excitation signal. a first monitoring module for monitoring whether or not the request for generating the excitation signal is issued, a second monitoring module for monitoring whether or not the musical tone signal is generated by the musical tone synthesis module; and an interruption module for interrupting execution of the musical tone synthesis module when the first monitoring module detects that the request for generating the excitation signal is not issued, and at the same time the second monitoring module detects that the musical tone signal is not generated.

With the above arrangement, the execution of the musical tone synthesis module is stopped only when a genuine no-tone generating condition is detected, whereby the computational load on the CPU can be reduced without being contrary to the player's intention.

The musical tone synthesis module is typically a physical model tone generator, but not necessarily limited to the physical tone generator. The present invention is effective to all musical tone synthesis modules which develop a delay time between the issue of the request for generating the excitation signal and the generation of the musical tone signal. The method of monitoring the request for generating the excitation signal by the first monitoring module includes a method of storing information related to the issue of the request in a buffer, and determining whether or not the stored information has a value equal to zero. Of course, this is not limitative, but any other method may be employed insofar as it can monitor whether or not the request is issued.

Further, as the method of monitoring the musical tone signal by the second monitoring module, various methods may be employed, similarly to the monitoring method by the first monitoring module. The software may be configured such that the interruption module is located within the musical tone synthesis module, or alternatively located outside the same.

Preferably, a time difference dependent on an amount of delay by which the excitation signal is delayed by the musical tone signal synthesis module is provided between timing of the monitoring by the first monitoring module and timing of the monitoring by the second monitoring module.

With the above arrangement, the accuracy of detection of the no-tone generating condition can be enhanced.

More preferably, the first monitoring module continues monitoring whether or not the request for generating the excitation signal is issued at least over a time period corresponding to the amount of delay.

Preferably, first conditions based on which the monitoring by the first monitoring module is carried out and second conditions based on which the monitoring by the second monitoring module are carried out are changed according to at least one characteristic of the musical tone signal generated by the musical tone synthesis module. This can further enhance the accuracy of detection of the no-tone generating condition.

More preferably, the at least one characteristic of the musical tone signal includes at least pitch of a musical tone represented by the musical tone signal, repetition period of the musical tone signal, and tone color of the musical tone.

More preferably, the tone generator system includes a first buffer for storing a signal indicative of the request for generating the excitation signal, and a second buffer for storing the musical tone signal, and the first conditions include at least one of length of the first buffer and a monitoring area within the first buffer, and wherein the second conditions include at least one of length of the second buffer and a monitoring area within the second buffer.

Preferably, the first monitoring module monitors a predetermined area within the first buffer.

Also preferably, the second monitoring module monitors a whole area of the second buffer.

Further preferably, the tone generator system includes a repetition period-monitoring module for detecting repetition period of the musical tone signal stored in the second buffer, and wherein the second monitoring module monitors an area within the second buffer corresponding to the repetition period of the musical tone signal detected by the repetition period-monitoring module.

To attain the above object, according to a second aspect of the invention, there is provided a storage medium storing a program executable by a computer, the program comprising a musical tone synthesis module for generating a musical tone signal by generating an excitation signal in response to an request for generating the excitation signal and at least delaying and looping the generated excitation signal, a first monitoring module for monitoring whether or not there exists the request for generating the excitation signal is issued, a second monitoring module for monitoring whether or not the musical tone signal is generated by the musical tone synthesis module, and an interruption module for interrupting execution of the musical tone synthesis module when the first monitoring module detects that the request for generating the excitation signal is not issued, and at the same time the second monitoring module detects that the musical tone signal is not generated.

The above and other objects, features, and advantages of the invention will become more apparent from the following detailed description taken in conjunction with the accompanying drawings.

DETAILED DESCRIPTION

The invention will now be described in detail with reference to drawings showing embodiments thereof.

Figure 1:
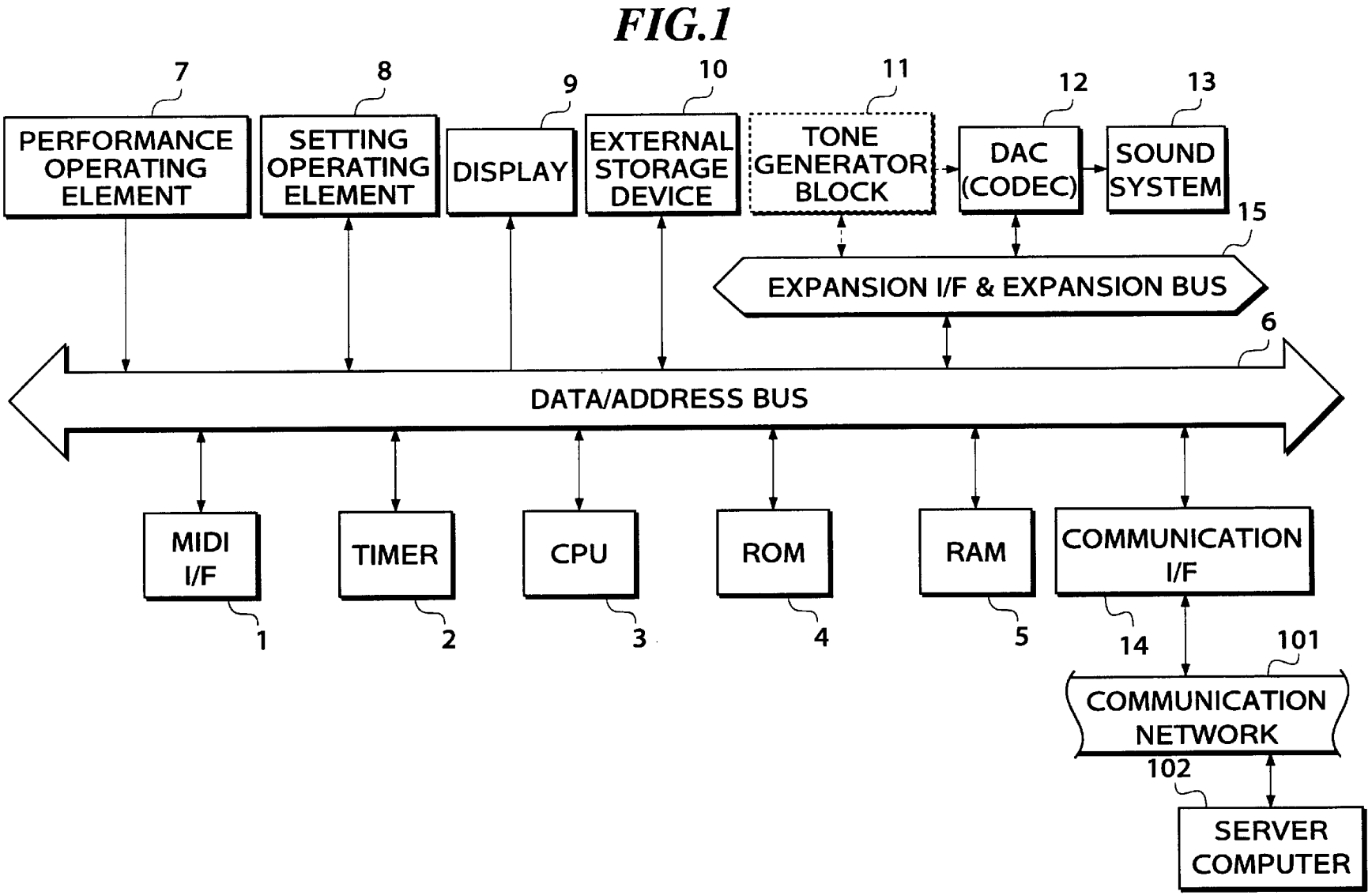
FIG. 1 is a block diagram schematically showing the whole arrangement of hardware implementing a tone generator system according to a first embodiment of the invention.

Referring first to FIG. 1, there is schematically shown the whole arrangement of hardware implementing a tone generator system according to a first embodiment of the invention. Most typically, the system is implemented by a general-purpose personal computer. The system has a main controller comprised of a CPU 3, under control of which an operating system (OS), a musical performance control application program, and a musical tone synthesis application program, and other programs are executed concurrently.

As shown in the figure, connected to the CPU 3 via a data/address bus 6 are a MIDI (musical instrument digital interface) I/F 1 via which MIDI messages are input from external devices and MIDI messages are output to external devices, a timer 2 for measuring timer interrupt time and other various kinds of time, a ROM (read-only memory) 4 storing various control programs, table data (including a tone color data library), etc., a RAM (random access memory) 5 for temporarily storing a selected one of MIDI files, various kinds of input information, results of various computations, etc., a performance operating element 7, such as a keyboard, a wheel, and a joy stick, a setting operating element 8, such as a keyboard and a mouse, a display 9, such as large-sized LCD or CRT, for displaying various kinds of information, an external storage device 10, such as floppy disk drive, hard disk drive, CD-ROM (compact disc read-only memory) drive, MO (magneto optical) drive, storing various application programs including various control programs executed by the CPU 3 as well as various data, and a communication interface (I/F) 14 for transmitting and receiving data e.g. to and from a server computer 102 via a communication network 101.

Further, connected to the data/address bus 6 via an extended interface (I/F) & expansion bus 15 is a DAC (digital-to-analog converter) 12 for converting a digital musical tone signal to an analog one. The DAC 12 is connected to a sound system 13 including e.g. an amplifier, loudspeaker, etc. for converting the output analog musical tone signal to a musical tone.

The DAC 12 performs part of the function of hardware called a CODEC (coder-decoder). The CODEC includes a buffer for storing a digital musical tone signal to be converted into an analog one to be output. The CPU 3 sequentially sends musical tone signals synthesized according to a software tone generation program (including at least a physical model tone generator program) to this buffer of the CODEC. The CODEC sequentially reads the stored digital musical tone signals at predetermined timing, and performs D/A conversion of the read signals, followed by delivering the converted signals to the sound system 13. In the present embodiment, musical tone signals are all synthesized by the CPU 3, so that the tone generator system does not require a tone generator block 11. However, this is not limitative, but the tone generator block 11 may be provided to share the task of synthesizing musical tone signals.

The external storage device 10 includes e.g. a hard disk storing not only software such as the OS, utility software, etc. but also software for implementing a software tone generator and other application software.

The communication I/F 14 is connected to the server computer 102 via the communication network 101, such as a LAN (local area network), the Internet, a telephone line, etc. If any of the various programs or parameters described above are not stored in the hard disk within the external storage device 10, the communication I/F 14 is used for downloading such program(s) or parameters from the server computer 102. In doing this, a client computer (i.e. the tone generator system of the present embodiment) issues a command for requesting download of the program(s) or parameters to the server computer 102 via the communication I/F 14 and the communication network 101. When the server computer sends, in response to this commend, the requested program(s) or parameters to the client computer via the communication network 101, the client computer receives them via the communication I/F 14, and stores them in the hard disk of the external storage means 10, whereby the download is completed.

Further, another interface may be provided for direct data transfer to and from external computers and so forth.

Figure 2:
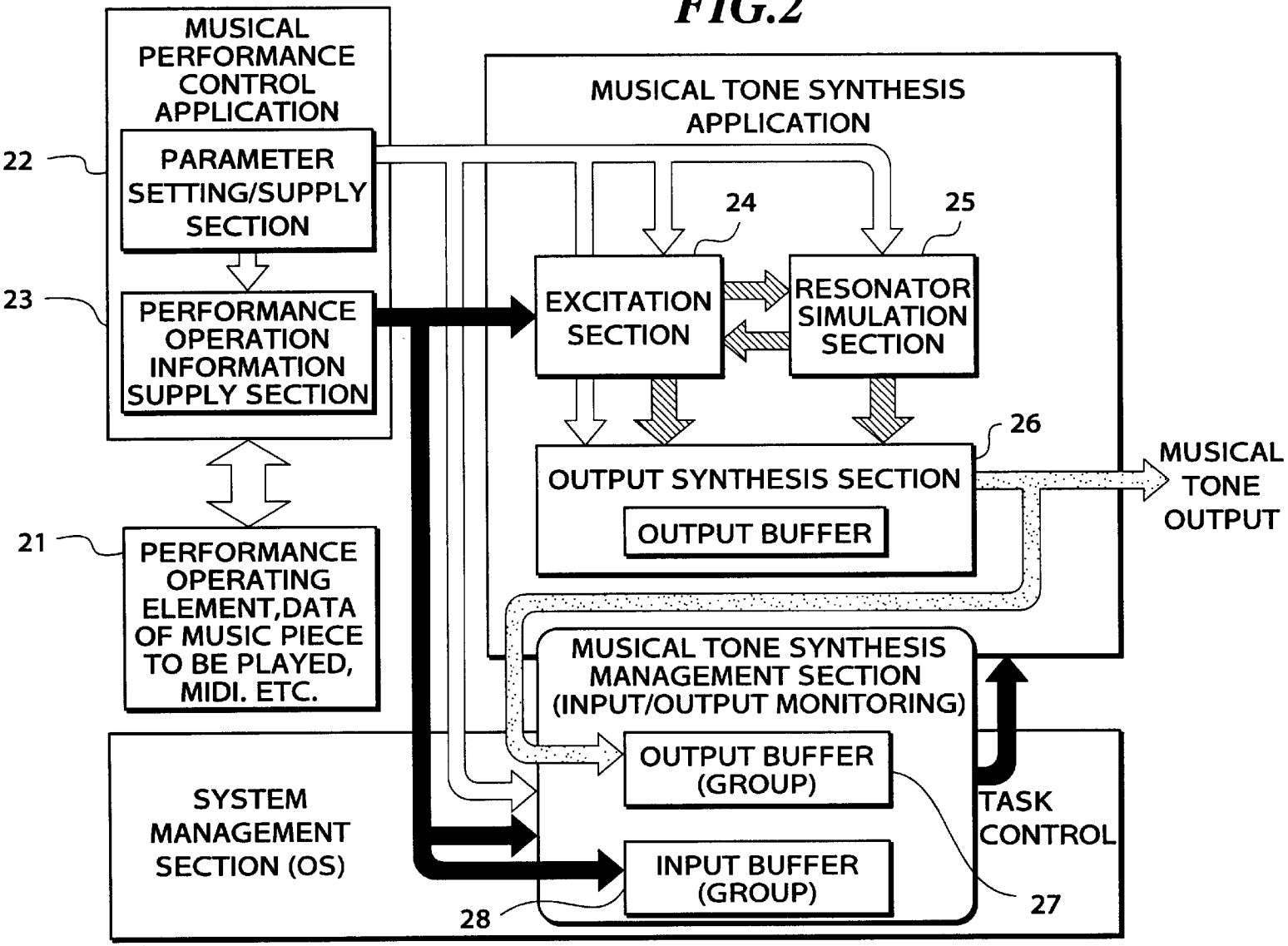
FIG. 2 is a diagram visually showing functions of the FIG. 1 tone generator system.

FIG. 2 provides a visual representation of functions of the tone generator system according to the first embodiment. The illustrated functions are limited to those specifically related to the physical model tone generator.

The tone generator system is capable of generating or synthesizing a plurality of kinds of musical tones by a plurality of tone generators based on respective different methods (e.g. a physical model tone generator, an FM (frequency modulation) tone generator, a PCM (pulse code modulation) tone generator, etc.). However, since the present invention is directed to tone generator control carried out when the physical model tone generator is selected for tone generation, FIG. 2 shows only the functions specifically related to the physical model tone generator.

Next, the functions of the tone generator system according to the embodiment will be described with reference to FIG. 2.

The tone generator system is mainly comprised of an input section 21 for inputting operating element information, data of music pieces to be played, MIDI messages, etc., the musical performance control application program (hereinafter referred to as "the musical performance control application") for generating musical performance control information based on various kinds of information input from the input section 21, the musical tone synthesis application program (hereinafter referred to as "the musical tone synthesis application") for synthesizing musical tone signals based on the musical performance control information generated by the musical performance control application, the OS, and a musical tone synthesis management section. Part of the functions of the musical tone synthesis management section is performed by a system management section of the OS.

The input section 21 corresponds to one of the MIDI I/F 1, the CPU 3, the performance operating element 7, and the setting operating element 8 in FIG. 1, depending on the kind of data (information) to be input. More specifically, the input section 21 corresponds to the performance operating element 7 when the operating element information is to be input, the CPU 3 when data of a music piece to be played is to be input, and the MIDI I/F 1 when a MIDI message is to be input.

The musical performance control application is comprised of a parameter setting/supply section 22 for setting and supplying various parameters for use in musical tone synthesis, and a performance operation information supply section 23 for triggering the start of the musical tone synthesis as well as supplying performance operation information based on which the synthesis is carried out. The parameter setting/supply section 22 sets various parameters based on data input from the input section 21, and supplies the parameters to the performance operation information supply section 23 as well as to the musical tone synthesis application and the musical tone synthesis management section. The performance operation information supply section 23 generates performance operation information based on the input data supplied from the input section 21 and the parameters supplied from the parameter setting/supply section 22, and supplies the information to the musical tone synthesis application and the musical tone synthesis management section. When a wind instrument is selected as a natural musical instrument to be simulated, pitch information, breath pressure information, embouchure information (i.e. information indicative of motion of lips, etc. of a player playing the instrument), other information concerning the amount of turbulent airflow (expiration noise), etc. are generated and supplied as the performance operation information, while when a string instrument is selected, pitch information, information indicative of a bow position with respect to a string, bow pressure information, bow speed information, etc. are generated and supplied as the performance operation information.

In FIG. 2. the white arrows indicate transfer of parameters, while the black arrows indicate transfer of the performance operation information. Further, the hatched arrows indicate transfer of digital musical tone signals.

The musical tone synthesis application is comprised of an excitation section 24 for generating an excitation signal, a physical model tone generator section implemented by a resonator simulation section 25 for simulating a resonator (e.g. a natural musical instrument such as a string instrument or a wind instrument) by delaying and looping various signals including the excitation signal, and an output synthesis section 26 for synthesizing a musical tone signal to be output by adding an envelope and various effects to the musical tone signal generated by the physical model tone generation section, as required. The output synthesis section 26 is provided with an output buffer for storing the synthesized musical tone signal.

The parameter setting/supply section 22 supplies the parameters to the excitation section 24, the resonator simulation section 25, and the output synthesis section 26. The performance operation information supply section 23 also supplies the performance operation information to the excitation section 24, which in turn generates an excitation signal from these pieces of information supplied from the sections 22 and 23 to generate and supply the excitation signal to the resonator simulation section 25 and the output synthesis section 26.

The resonator simulation section 25 delays the excitation signal sent from the excitation section 24 by a delay amount corresponding to the supplied parameters and loops the same in a manner corresponding to the supplied parameters to thereby simulate the sounding mechanism of a desired natural musical instrument for generation of a musical tone signal. The section 25 feeds back one of the thus generated musical tone signals detected at a predetermined position, to the excitation section 24, and another musical tone signal detected at another predetermined position to the output synthesis section 26.

The output synthesis section 26 imparts an envelope and various effects as required to the musical tone signal generated as described above, for synthesis of a musical tone signal to be output, and stores this signal in the output buffer. The musical tone signal stored in the output buffer is read out at predetermined timing, delivered to the DAC 12 via the extended I/F & expansion bus 15, and then stored in the buffer of the CODEC.

The musical tone signal output from the output synthesis section 26 is also supplied to the musical tone synthesis management section. The musical tone synthesis management section manages the synthesized musical tone signal, and includes an output buffer 27 for storing musical tone signals and an input buffer 28 for storing performance operation information sent from the performance operation information supply section 23. According to the present embodiment, data stored in the output buffer 27 and the input buffer 28 are monitored, and when the data fulfill predetermined conditions, a task of the musical tone synthesis application is controlled. More specifically, musical tone-generating processing by the physical model tone generation section is stopped.

The output buffer 27 and the input buffer 28 each have an area of the RAM 5 allocated thereto and operate as a so-called ring buffer. Allocation of the areas to the output buffer 27 and the input buffer 28 can be carried out during an initialization process at the start of a main routine, described hereinafter with reference to FIG. 5. Of course, this is not limitative, but allocation of the buffer areas may be carried out when the buffers 27 and 28 are needed, e.g. when tone generator-related software is started or when the performance of a music piece is started.

Further, in the present embodiment, since the musical tone synthesis management section performs task control of the software application (musical tone synthesis application), the section uses part of the functions of the system management section of the OS. That is, the musical tone synthesis management section is a program similar to a driver rather than an application program. However, this is not limitative, but this section may be implemented by an application program, or it may operate only by utilizing functions provided by the OS.

Figure 3:
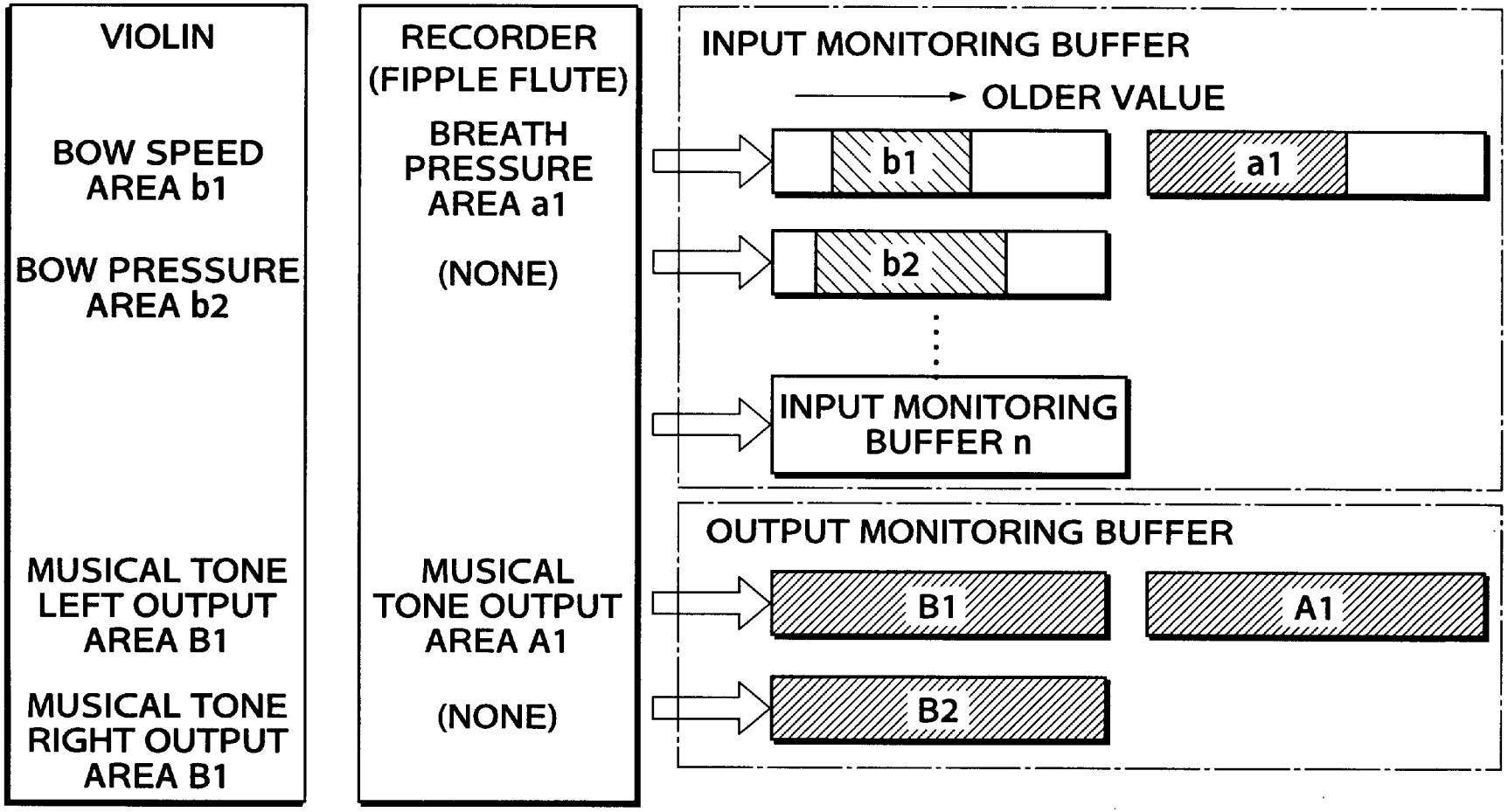
FIG. 3 is a diagram which is useful in explaining a method of monitoring an input (monitoring) buffer and an output (monitoring) buffer.

Next, a method of monitoring the input (monitoring) buffer 28 and the output (monitoring) buffer 27 will be described with reference to FIG. 3.

As shown in the figure, the input buffer 28 and the output buffer 27 are each comprised of a plurality of buffers (buffer group). In the illustrated example, the latest data is stored at a left end of each of the buffer groups. That is, data is stored in each of the buffer groups such that an older data item is stored at a location closer to a left end thereof.

One illustrated buffer of the input buffer (comprised e.g. of n buffers) 28, which is provided with an area a1, is a buffer storing breath pressure information supplied by the performance information supply section 23 when a recorder (fipple flute) is selected as a natural musical instrument to be simulated. One illustrated buffer of the output buffer (comprised e.g. of 2 buffers) 27, which is provided with an area A1, is a buffer storing the musical tone signal synthesized by and output from the output synthesis section 26. The areas a1 and A1 in the figure each represent an area over which data monitoring is performed. More specifically, as to the input buffer 28, data monitoring is performed over part thereof, while as to the output buffer 27, data monitoring is performed over the whole thereof. The reason why data monitoring is performed over part of the input buffer 28 is that this suffices for detecting a no tone-generating condition of the physical model tone generator. Further, the reason why data monitoring is performed not on one point but over an area is that there is a delay between the issue of the breath information and the storing of a corresponding musical tone signal in the output buffer 27. On the other hand, the reason why data monitoring is performed over the whole of the output buffer 27 is that since the repetition period of the synthesized musical tone signal is not taken into consideration or detected, it is impossible to determine which part of the whole area of the output buffer 27 should be monitored. Therefore, if a maximum value of the repetition period of the synthesized musical tone signal is given, it will be sufficient to monitor an area corresponding to the repetition period. If the number of buffers, length of each buffer, and the monitoring area of each buffer are controlled according to the tone and pitch (repetition period) of a musical tone to be synthesized, enhanced accuracy of monitoring of generation of the musical tone can be expected.

Figure 4A:
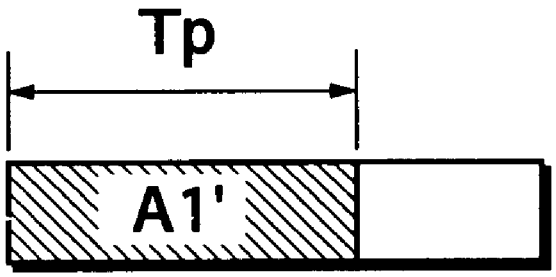
FIG. 4A is a diagram schematically showing a buffer of the output buffer provided with an area for data monitoring.
Figure 4B:
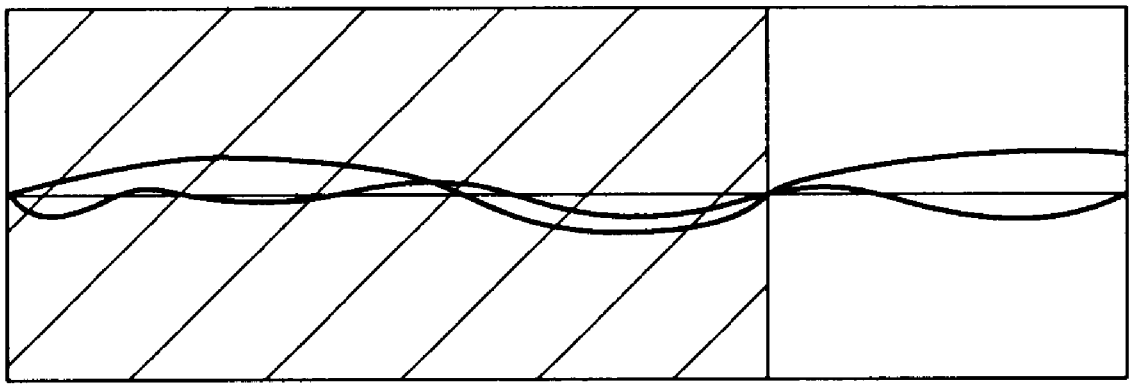
FIG. 4B is a diagram showing waveforms of tone signals stored in the FIG. 4A buffer.

FIGS. 4A and 4B show an example in which the output buffer 27 is also provided with a data monitoring area. FIG. 4A shows one output buffer having the monitoring area provided therefor, while FIG. 4B shows various musical tone signal waveforms stored in the FIG. 4 output buffer.

In FIG. 4B, the hatched area indicates an area which covers all musical tone signals synthesized. Therefore, it is possible to detect a no tone-generating condition with accuracy simply by monitoring the area A1 of the output buffer 27, which is defined by the repetition period Tp corresponding to the hatched area in FIG. 4B.

Although in the example illustrated in FIGS. 4A and 4B, the buffer area for monitoring is determined based on the maximum values of repetition periods of all musical tones that are to be synthesized for sounding, this is not limitative, but the buffer area may be determined with reference to a specific one of the musical tones that are to be synthesized for sounding or a one selected based on certain conditions (e.g. "the average of data of the first to third lowest-pitch tones" or "the sum of data of the lowest-pitch tone and the highest-pitch tone"). Further, the buffer length, the monitoring area, and so forth may be set to respective predetermined fixed values for simplicity.

Referring again to FIG. 3, one of the two buffers of the input buffer 28, which is provided with an area b1, stores the bow speed information supplied from the performance information supply section 23 when a violin is selected as a natural musical instrument to be simulated, while a buffer provided with an area b2 stores the bow pressure information supplied from the section 23. On the other hand, one of the two buffers of the output buffer 27, which is provided with an area B1, stores one of two musical tone signals synthesized by the musical tone synthesis section 26, while a buffer provided with an area B2 stores the other musical tone signal.

The reason why the areas b1 and b2 are provided at respective intermediate portions of the buffers is that the latest input data need not be monitored because, in the case of a violin, there is a longer delay time period between the supply of the bow pressure and bow speed information and the synthesis of the resulting musical tone signal than in the case of a recorder. Further, the reason why the area b2 is provided in a manner overlapping the entire area b1 with its opposite ends located outward of the latter is that, in a performance by violin, generally the bow speed is sensed after generation of the bow pressure. On the other hand, data monitoring is performed over the whole area of the output buffer 27 for the same reason as in the case of a recorder. However, the monitoring may be performed over part of the whole buffer area as described above with reference to FIGS. 4A and 4B.

In the present embodiment, data monitoring is performed by determining whether data is not actually stored in either of the input buffer 28 and the output buffer 27 (i.e. the data value is equal to "0" in each of the input and output buffers 27, 28).

Needless to say, this is not limitative, but a monitoring method may be employed in which a buffer or a predetermined area provided in the buffer is monitored to detect whether there is at least one data item whose data value is not equal to "0", and if one or more data items whose data values are not equal to "0" are detected, it is judged that the physical model tone generator is generating a musical tone, i.e. in a musical tone-generating condition. Further, another method may be employed in which the number of data items each having a data value which is not equal to "0" is detected, and if the number is larger than a predetermined number, it is judged that the physical model tone generator is in the musical tone-generating condition. Still another method may be employed in which the level of each data item is detected, and when at least one data item whose data level exceeds a predetermined level is detected, it is judged that the physical model tone generator is in the musical tone-generating condition. Further, it is also possible to employ a method in which an average value (effective value) of each data item, a cumulative value (integral value) of the absolute value of the data item, or the like is calculated, and if the calculated value exceeds a predetermined value, it is judged that the physical model tone generator is in the musical tone-generating condition. Moreover, the data monitoring may be made only with respect to a predetermined frequency component of a waveform of a musical tone signal to be monitored. The predetermined or specific frequency component may be determined by a spectrum or power thereof obtained through analysis e.g. by FFT (Fast Fourier transformation). Still further, a monitoring method may be used in which the pitch of the musical tone is detected to calculate the content of a fundamental wave or harmonic tones thereof, and the judgment is made based on results of the calculation.

Although in the present embodiment, the output buffer 27 of the musical tone synthesis management section is monitored, this is not limitative, but the output buffer of the output synthesis section 26 or the buffer of the CODEC may be monitored instead. Further, a signal subjected to delay by the physical model tone generator, which essentially employs delay calculation, may be directly monitored, to thereby dispense with the monitoring over the output buffer.

Further, a (musical tone) signal within the excitation section 24 or within the resonator simulation section 25 may be monitored, or signals within a plurality of sections may be monitored to determine whether a musical tone signal exists (is generated), based upon results of the monitoring, according to a predetermined criterion.

Figure 5:
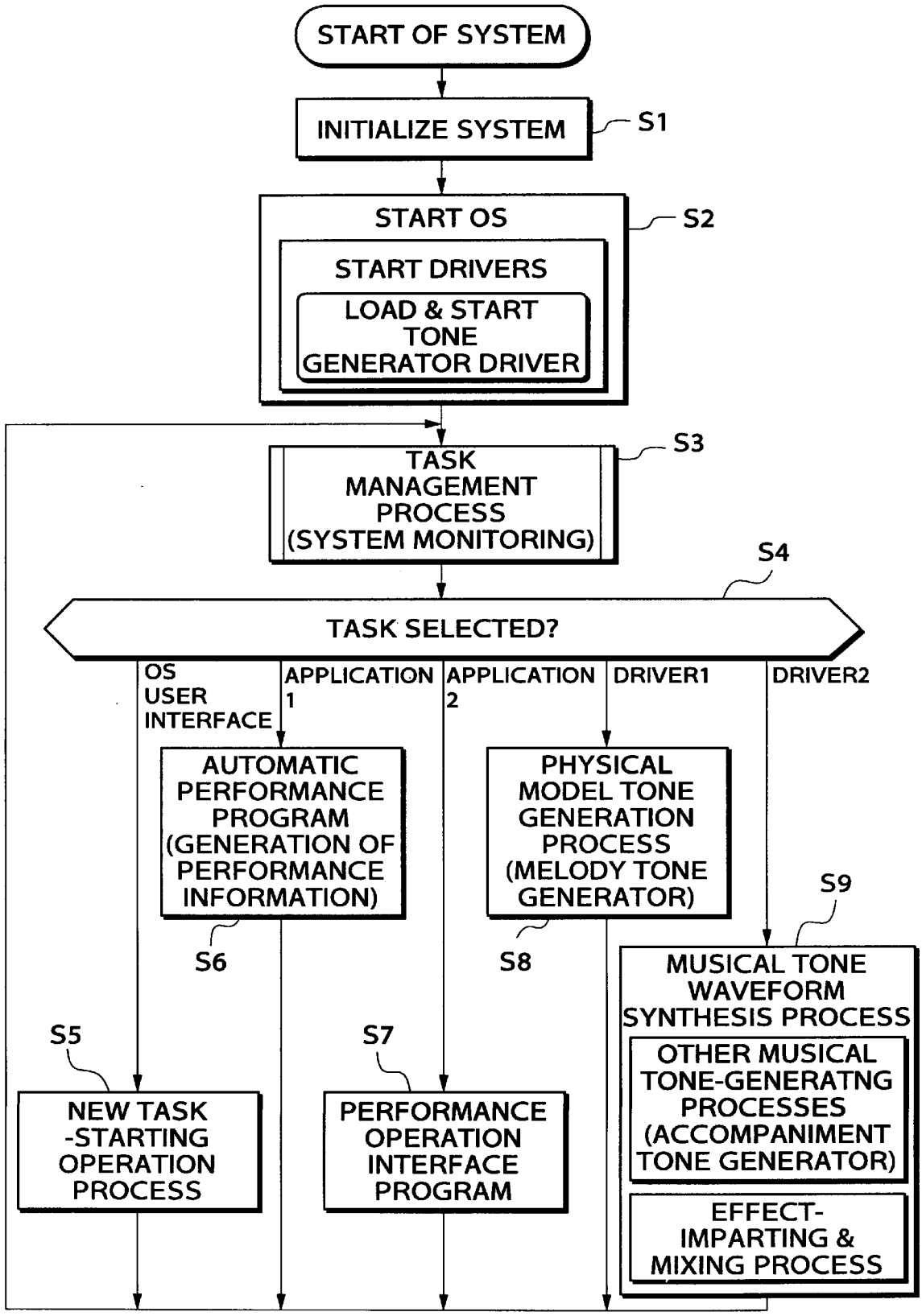
FIG. 5 is a flowchart showing a main routine executed by the FIG. 1 tone generator system.

FIG. 5 shows a main routine executed by the tone generator system according to the first embodiment, particularly by the CPU 3 of the system.

First, the main routine is started e.g. when a power switch (not shown) of the system is turned on (i.e. when the system is started). At a step S1, an initialization program stored in the ROM 4 or the like is executed to carry out initialization processing, such as reading the OS and others designated by the initialization program e.g. from the external storage device 10.

Then, an OS-starting process for starting the OS which has been read out is carried out at a step S2. The OS-starting process includes starting various drivers, such as loading and starting a tone generator driver.

At the following step S3, a task management process (system monitoring) is executed to carry out task management, including designation of one of various tasks. At a step S4, a task selection process is carried out to selectively execute a step corresponding to the task designated by the task management process.

The task management process, designates one of the following three kinds of tasks:

(1) User interface-related task (2) Application-related task (3) Driver-related task The task selection process selects a process corresponding to the designated task, and then the main routine proceeds to a step corresponding to the selected process.

The user interface-related task (1) is e.g. a task of starting an application software program which is started by selecting a corresponding icon on the display 9 by the user (player).

If the task (1) is designated by the task selection process at the step S4, a new task-initiating operation process is executed to start a new task corresponding to the designated task at a step S5, followed by the main routine returning to the step S3.

If the task (2) is designated by the task selection process at the step S4, the main routine proceeds to execution of an application program corresponding to the designated task. In FIG. 5, two application programs are shown, one of which is selected for execution, depending upon the content of the designated task (2). More specifically, if Application 1 is designated, the main routine proceeds to a step S6, wherein performance information is generated by an automatic performance program. On the other hand, if Application 2 is designated, the main routine proceeds to a step S7, wherein a performance operation interface program is executed. In execution of this program, if the player operates the performance operating element, information associated with the operating element is input.

The number of application programs need not be limited to "2", but a number of application programs dependent upon the OS and the capacity of the RAM 5 may be selectively executed.

Further, if the task (3) is designated by the task selection process at the step S4, the main routine proceeds to execution of a driver program corresponding to the designated task. In FIG. 5, two driver programs are shown, one of which is selected for execution, depending upon the content of the designated task (3). More specifically, if Driver 1 is designated, the main routine proceeds to a step S8, wherein the physical model tone generator program is executed to generate a melody tone. On the other hand, if Driver 2 is designated, the main routine proceeds to a step S9, wherein a musical tone waveform synthesis program is executed to generate an accompaniment tone. In the present embodiment, the musical tone waveform synthesis program includes musical tone generation processes other than the physical model tone generation process, for generating accompaniment tones, and an effect-imparting & mixing process for imparting effects to the generated accompaniment tone as well as mixing a plurality of accompaniment tones.

The number of driver programs need not be limited to "2", either, but a number of driver programs dependent upon the OS may be selectively executed.

Figure 6:
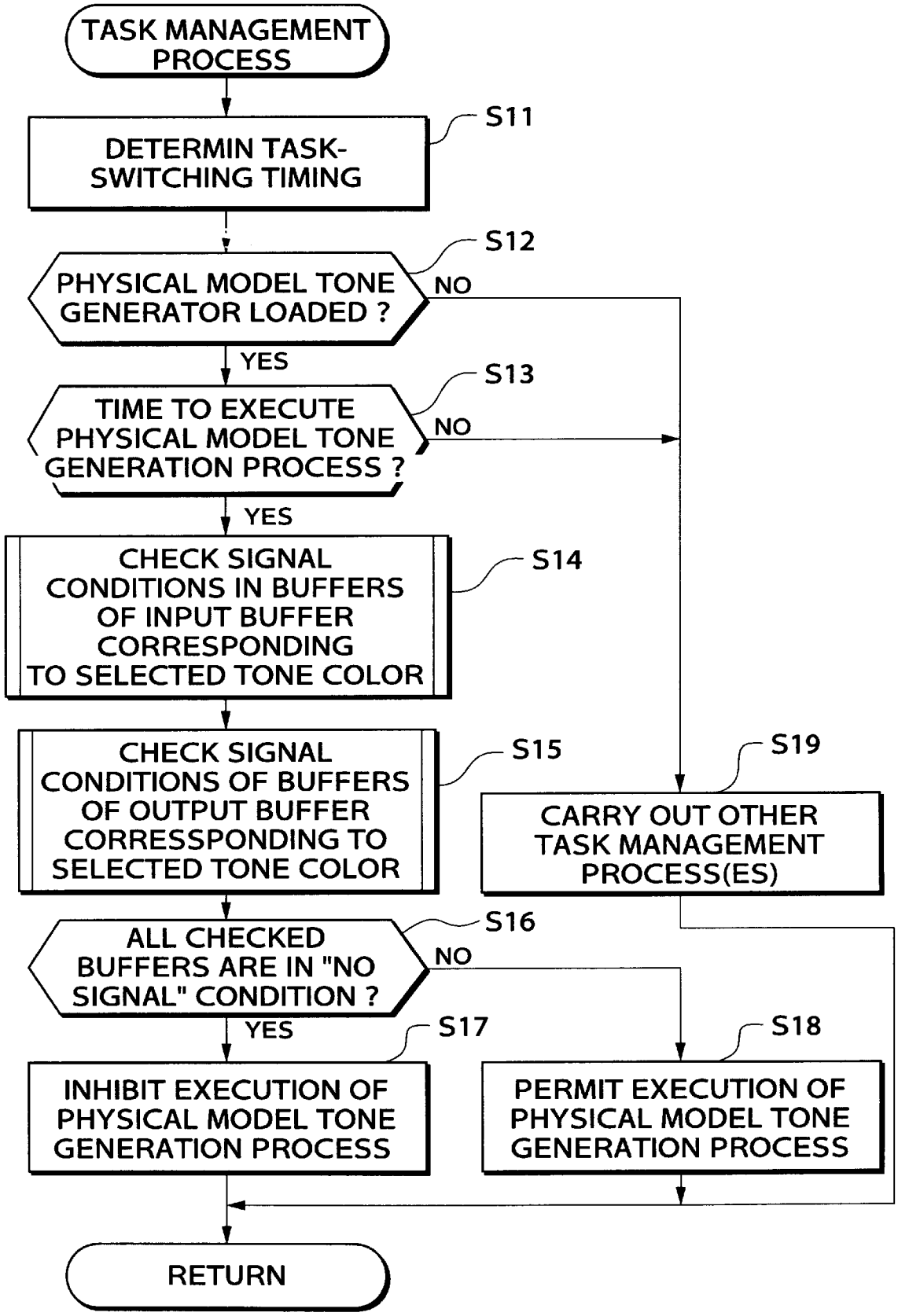
FIG. 6 is a flowchart showing details of a task management process.

FIG. 6 shows details of the task management process.

First, a task to be selected is designated and timing for starting the designated task is determined at a step S11.

Then, it is determined at a step S12 whether or not the physical model tone generator is loaded as a tone generator driver. If the physical model tone generator is loaded, it is determined at a step S13 whether or not it is time to execute the physical model tone generation process.

If it is time to execute this process, signal conditions of a buffer or buffers of the input buffer (group) 28 corresponding to a selected tone color are checked at a step S14, and signal conditions of buffers of the output buffer (group) 27 are checked at a step S15. In checking the signal conditions at the step S15, when the number of buffers of the output buffer 27 is small, all the buffers are checked, whereas when the number of buffers is large, only buffers corresponding to the selected tone color are checked.

Figure 7:
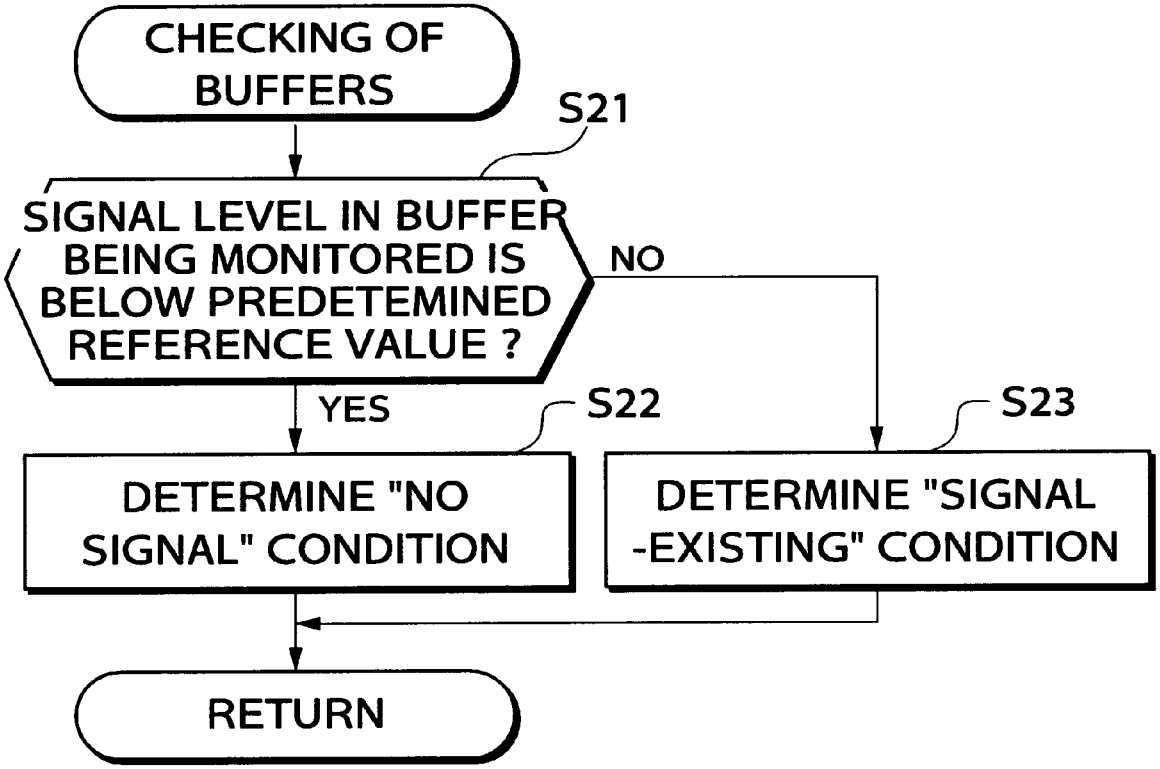
FIG. 7 is a flowchart showing details of a process for checking signal conditions of the buffers.

FIG. 7 shows details of the process for checking signal conditions of the buffers, which is executed at each of the steps S14 and S15 of FIG. 6.

At a step S21 in FIG. 7, it is determined whether or not the level of the signal in the buffer being monitored (the input buffer 28 at the step S14, or the output buffer 27 at the step S14) is equal to or lower than a predetermined level. If the signal level is equal to or lower than the predetermined level, it is judged at a step S23 that the buffer is in a "no signal" condition, whereas if the signal level is larger than the predetermined level, it is judged at a step S23 that the buffer is in a "signal-existing" condition.

When a plurality of buffers are to be monitored, the buffers are monitored sequentially, and the processing described above is repeatedly carried out as many times as the number of the buffers to be monitored.

Referring again to FIG. 6, it is determined at a step S16 whether or not all of the checked buffers are in the "no signal" condition. If the buffers are all in the "no signal" condition, it is determined that execution of the physical model tone generation process is to be inhibited at a step S17, whereas if any of the buffers is not in the "no signal" condition, it is determined that execution of the physical model tone generation process is to be permitted at a step S18. As a result, if the execution of the physical model tone generation process is determined to be inhibited, the same process is not designated at the step S11, whereas if the process is determined to be permitted, it is designated at the step S11.

On the other hand, if the physical model tone generator is not loaded at the step S12, or if it is not time to execute the physical model tone generation process at the step S13, other task management process(es) are executed at a step S19, followed by terminating the present task management process.

Figure 8:
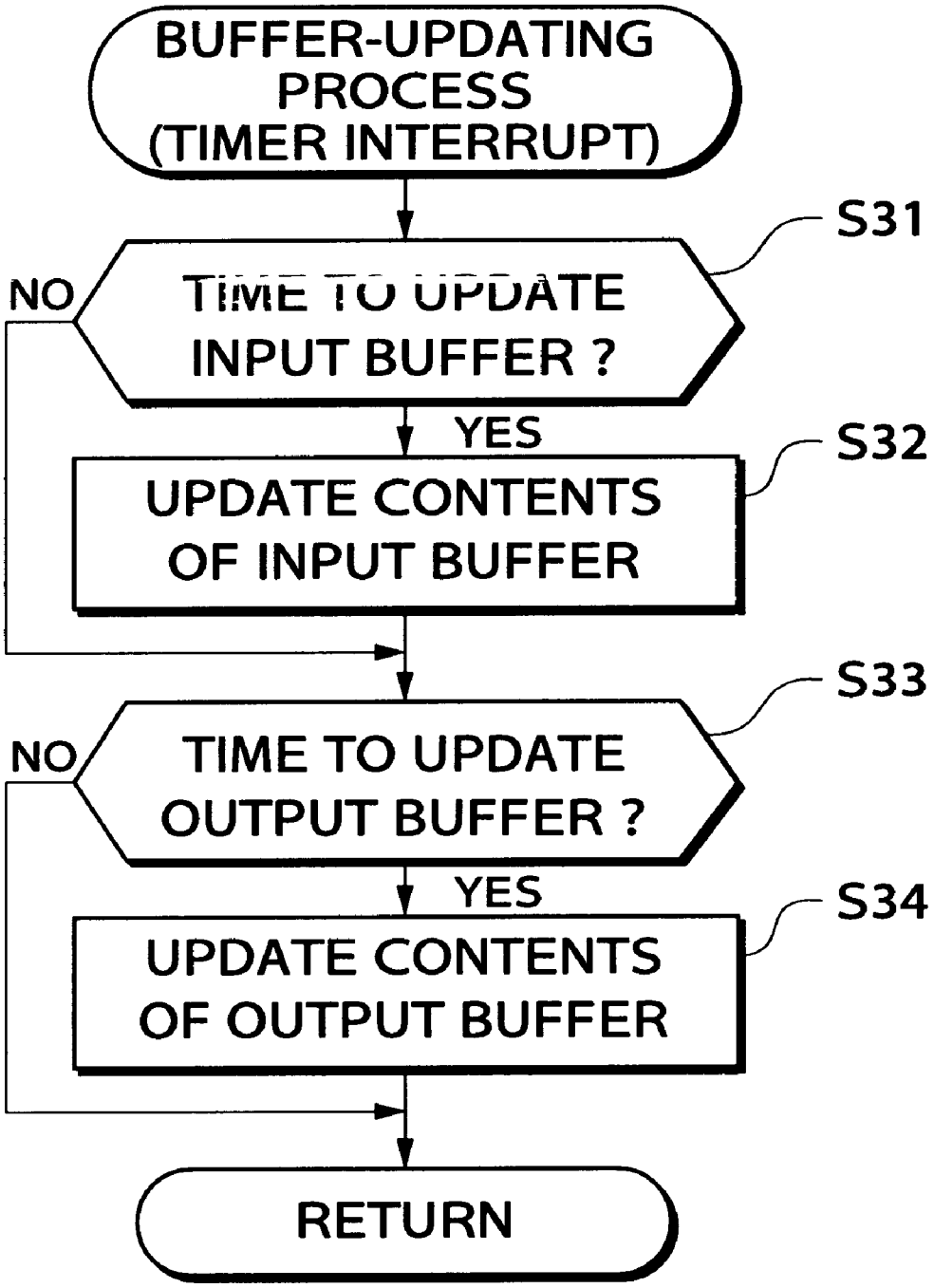
FIG. 8 is a flowchart showing a buffer updating-process.

FIG. 8 shows a buffer-updating process. This process is started and executed in response to a timer interrupt signal generated by the timer 2 at predetermined time intervals (e.g. 5 msec).

First, it is determined at a step S31 whether or not it is time to update the input buffer 28. If it is time for updating, the contents of the input buffer 28 are updated at a step S32, whereas if it is not time for updating, the step S32 is skipped over.

Then, it is determined at a step S33 whether or not it is time to update the output buffer 29. If it is time for updating, the contents of the output buffer are updated at a step S34, whereas if it is not time for updating, the step S34 is skipped over, followed by terminating the present buffer-updating process.

The updating of the contents of the input/output buffer at the step S32 or S34 may be carried out e.g. by storing a signal (performance operation information sent from the performance operation information supply section 23 or musical tone signals from the output synthesis section 26) received at the time of updating as the latest data, as it is, or by processing the signal and then storing the same as the latest data. The processing of the signal may be carried out e.g. by calculating an absolute value or average value of the signal or by subjecting the signal to filtering calculation.

As described above, according to the present embodiment, it is determined whether or not a synthesized musical tone signal exists and whether or not a request or command for synthesis of the musical tone signal exists, and only if neither of them exists, i.e. only when a genuine no tone-generating condition exists, execution of the physical model tone generation process is inhibited. As a result, it is possible to reduce the computational load on the CPU without being contrary to the player's intention.

Next, a tone generator system according to a second embodiment will be described.

The tone generator system according to the second embodiment is distinguished from the system according to the first embodiment described above only in timing of determining whether the execution of the physical model tone generation process should be stopped. Therefore, description will be made only of those which differ from the first embodiment.

More specifically, the tone generator system according to the second embodiment is distinguished from the system according to the first embodiment in part of the task management process executed at the step S3 of the FIG. 5 main routine and part of the physical model tone generation process executed at the step S8 of the same. First, the difference in the physical model tone generation process, and then the difference in the task management process will be described.

Figure 9:
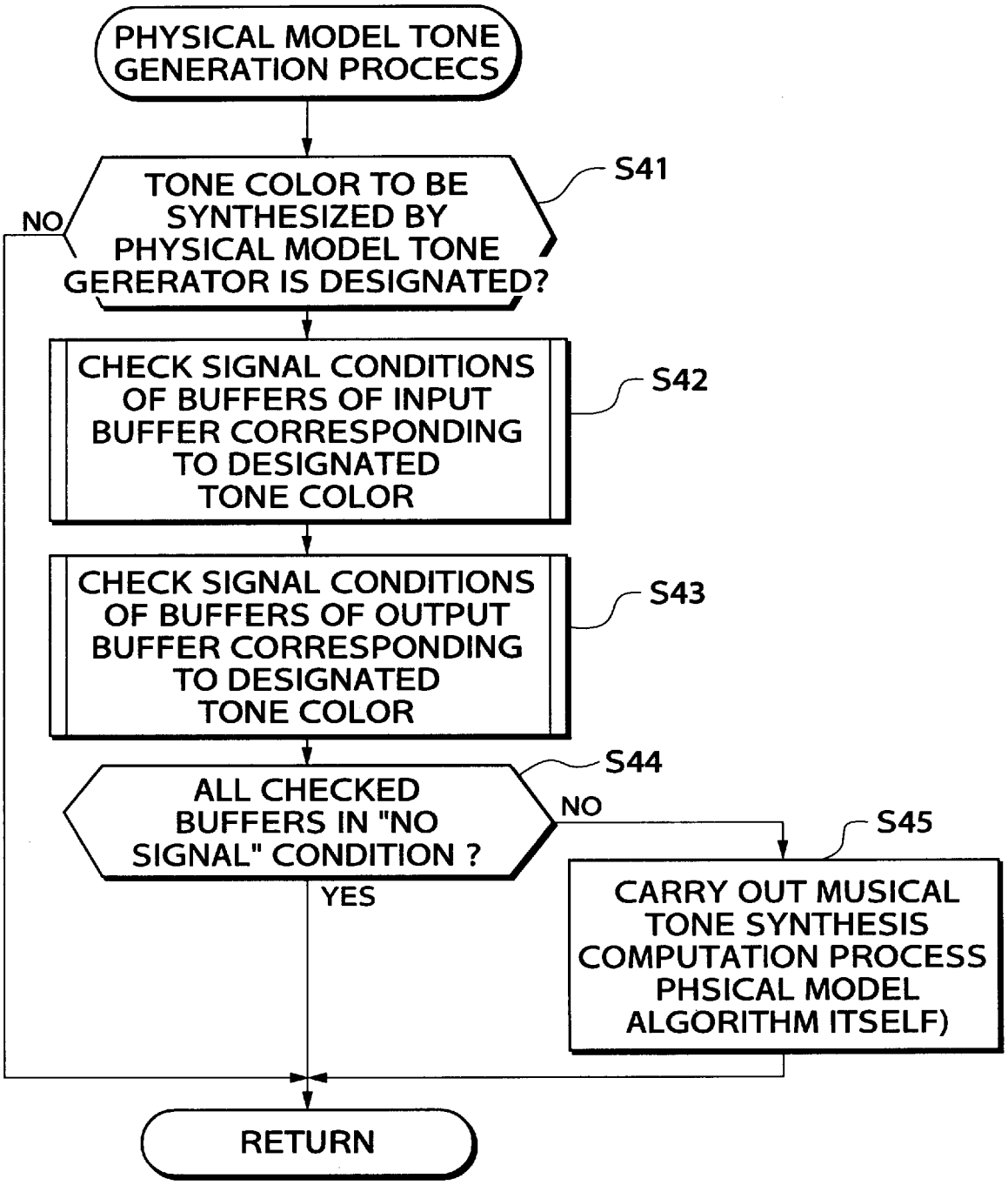
FIG. 9 is a flowchart showing details of physical model tone generation processing executed by a tone generator system according to a second embodiment of the invention.

FIG. 9 shows details of the physical model tone generation process executed by the tone generator system according to the second embodiment.

First, it is determined at a step S41 whether or not a tone color to be synthesized by the physical model tone generator is designated. If the tone color is not designated, the physical model tone generation process is immediately terminated, whereas if the tone color is designated, the program proceeds to a step S42.

Processes executed at the step S42 to a step S44 are similar to those executed at the steps S14 to S16, and hence description thereof is omitted.

If any one of the buffers checked at the step S44 is not in the "no signal" condition, a musical tone synthesis computation process by the physical model tone generator, i.e. a physical model tone-generating algorithm itself, is carried out at a step S45. On the other hand, if the checked buffers are all in the "no signal" condition, the step S45 is skipped over, and the present physical model tone generation process is terminated.

In this embodiment, since the existence of the genuine no tone-generating condition is monitored during the physical model tone generation process, the task management process need not carry out this monitoring. Therefore, in the task management process of the present embodiment, the monitoring process executed by the task management process shown in FIG. 6, more specifically, the processes executed at the steps S14 to S17 in the figure, are omitted.

Also in this embodiment, similarly to the first embodiment, the existence of a synthesized musical tone signal and the issue of a request or command for synthesis of the musical tone signal are detected, and only if neither of them exists, execution of the physical model tone generation process is inhibited. Therefore, it is possible to reduce the computational load on the CPU without being contrary to the player's intention.

Although the physical model tone generator is employed by way of example in the above two embodiments, the present invention is effective to any tone generator in which a delay occurs between the time point the synthesis of a musical tone signal is requested and the time point the actual synthesis of the same is completed. Therefore, the present invention is not limited to the physical model tone generator, though the invention is effective particularly to the physical model tone generator. In an arrangement that a plurality of (kinds of) tone generators to which the invention is applicable are operated for synthesis of musical tone signals, the monitoring of the no tone-generating condition may be performed per each tone generator.

Although in the above described embodiments, the input signal (performance operation information) and the output signal (musical tone signal(s)) are separately monitored for detection of the no tone-generating condition, this is not limitative, but a result of combination of the two signals through some computation or the like may be monitored. Further, in the arrangement that a plurality of (kinds of) tone generators to which the invention is applicable are operated for synthesis of musical tone signals, the monitoring of the no tone-generating condition may be performed per each tone-generating channel or each group of tone-generting channels. Alternatively, a result of combination of the input/output signals to and from each channel may be monitored.

Further, although in the above described embodiments, the length of each buffer to be monitored and the area of each buffer to be monitored are fixed (though the length of each buffer to be monitored may be changed as described with reference to FIGS. 4A and 4B), this is not limitative, but they may be changed in dependence on tone color, tone color group (kind of a musical instrument), pitch repetition period Tp, etc.

Further, the area of each buffer to be monitored may be increased or decreased according to the pitch of a musical tone to be generated. For instance, the buffer area may be reduced as the pitch is higher or the pitch repetition period is shorter, such that the no tone-generating condition can be detected with enhanced accuracy, and at the same time the load on the CPU during the monitoring process can be decreased.

Still further, the correlation between the location of each buffer to be monitored and the kind of a corresponding signal to be monitored, the capacity of each buffer, the area of each buffer to be monitored, etc. may be newly set or changed, and the set values thereof may be stored as tone parameters.

Although in the above described embodiments, the invention is implemented by a general-purpose computer, this is not limitative, but the invention can be applied to any other systems or apparatuses in which a software tone generation process can be executed, such as electronic musical instruments, amusement apparatuses (typically, game machines and karaoke machines), and various kinds of household electrical appliances.

Further, the object of the invention can be attained by supplying a system or apparatus with a storage medium storing a software program that realizes the functions of the present invention, and causing a computer (or CPU or MPU) of the system or apparatus to read out and execute the program stored in the storage medium.

In this case, the program itself read from the storage medium realizes the novel functions of the invention, and the storage medium storing the program constitutes the invention.

The storage medium for supplying the program to the system or apparatus may be selected from hard disk, CD-ROM, MO, MD, floppy disk, CD-R (compact disk-recordable), magnetic tape, nonvolatile memory card, and ROM, for example. Alternatively, the program may be supplied from the server computer 102 via another MIDI interface or the communication network 101.

Further, the functions of the invention may also be realized by executing a program read by a computer, or causing an operating system (OS) that operates on the computer, to carry out a part or the whole of the actual operations in response to commands or instructions from the program.

Furthermore, the program read from the storage medium may be written into a memory provided in an expanded board inserted in the computer or in an expanded unit connected to the computer, and then a CPU or the like provided in the expanded board or expanded unit may actually carry out a part or the whole of the actual operations in response to commands or instructions from the program, so as to realize the functions of the invention.

What is claimed is:

1. A tone generator system using computer software, the computer software comprising:

a musical tone synthesis module for generating a musical tone signal by generating an excitation signal in response to an request for generating said excitation signal and at least delaying and looping the generated excitation signal;

a first monitoring module for monitoring whether or not said request for generating said excitation signal is issued;

a second monitoring module for monitoring whether or not said musical tone signal is generated by said musical tone synthesis module; and an interruption module for interrupting execution of said musical tone synthesis module when said first monitoring module detects that said request for generating said excitation signal is not issued, and at the same time said second monitoring module detects that said musical tone signal is not generated.

2. A tone generator system according to claim 1, wherein a time difference dependent on an amount of delay by which said excitation signal is delayed by said musical tone signal synthesis module is provided between timing of the monitoring by said first monitoring module and timing of the monitoring by said second monitoring module.

3. A tone generator system according to claim 2, wherein said first monitoring module continues monitoring whether or not said request for generating said excitation signal is issued at least over a time period corresponding to said amount of delay.

4. A tone generator system according to claim 1 or 2, wherein first conditions based on which the monitoring by said first monitoring module is carried out and second conditions based on which the monitoring by said second monitoring module are carried out are changed according to at least one characteristic of said musical tone signal generated by said musical tone synthesis module.

5. A tone generator system according to claim 4, wherein said at least one characteristic of said musical tone signal includes at least pitch of a musical tone represented by said musical tone signal, repetition period of said musical tone signal, and tone color of said musical tone.

6. A tone generator system according to claim 4, including a first buffer for storing a signal indicative of said request for generating said excitation signal, and a second buffer for storing said musical tone signal, and wherein said first conditions include at least one of length of said first buffer and a monitoring area within said first buffer, and wherein said second conditions include at least one of length of said second buffer and a monitoring area within said second buffer.

7. A tone generator system according to claim 6, wherein said first monitoring module monitors a predetermined area within said first buffer.

8. A tone generator system according to claim 6, wherein said second monitoring module monitors a whole area of said second buffer.

9. A tone generator system according to claim 6, including a repetition period-monitoring module for detecting repetition period of said musical tone signal stored in said second buffer, and wherein said second monitoring module monitors an area within said second buffer corresponding to the repetition period of said musical tone signal detected by said repetition period-monitoring module.

10. A storage medium storing a program executable by a computer, the program comprising: a musical tone synthesis module for generating a musical tone signal by generating an excitation signal in response to an request for generating said excitation signal and at least delaying and looping the generated excitation signal;

a first monitoring module for monitoring whether or not said request for generating said excitation signal is issued;

a second monitoring module for monitoring whether or not said musical tone signal is generated by said musical tone synthesis module; and an interruption module for interrupting execution of said musical tone synthesis module when said first monitoring module detects that said request for generating said excitation signal is not issued, and at the same time said second monitoring module detects that said musical tone signal is not generated.

* * * * *